United States Patent [19]

Bachner

[11] 4,270,593

[45] Jun. 2, 1981

[54] METHOD OF CHANGING THE CROSS SECTIONAL FORMAT OF A STRAND AND A PLATE MOULD FOR CARRYING OUT THE METHOD

[75] Inventor: Ernst Bachner, Linz, Austria

[73] Assignee: Voest-Alpine Aktiengesellschaft, Linz, Austria

[21] Appl. No.: 46,480

[22] Filed: Jun. 7, 1979

[30] Foreign Application Priority Data

Jun. 14, 1978 [AT] Austria ..... 4326/78

[51] Int. Cl.[3] ..... B22D 11/04

[52] U.S. Cl. ..... 164/82; 164/436

[58] Field of Search ..... 164/82, 436

[56] References Cited

U.S. PATENT DOCUMENTS

| | | | |
|---|---|---|---|
| 3,292,216 | 12/1966 | Colombo | 164/436 |
| 3,760,867 | 9/1973 | Murakami et al. | 164/436 |
| 3,838,730 | 10/1974 | Nagaoka et al. | 164/436 |
| 3,926,244 | 12/1975 | Meier et al. | 164/82 X |
| 4,010,793 | 3/1977 | Takemura et al. | 164/436 X |
| 4,085,793 | 4/1978 | Scheinecker et al. | 164/436 |
| 4,086,951 | 5/1978 | Takahasi et al. | 164/436 X |
| 4,134,441 | 1/1979 | Ohmori et al. | 164/82 X |

FOREIGN PATENT DOCUMENTS

| | | | |
|---|---|---|---|
| 297287 | 4/1917 | Fed. Rep. of Germany . | |
| 2018962 | 11/1971 | Fed. Rep. of Germany . | |
| 2500395 | 7/1975 | Fed. Rep. of Germany . | |
| 51-14825 | 2/1976 | Japan | 164/436 |
| 54-3452 | 2/1979 | Japan | 164/436 |

*Primary Examiner*—Robert D. Baldwin
*Attorney, Agent, or Firm*—Brumbaugh, Graves, Donohue & Raymond

[57] ABSTRACT

A method of changing the cross-sectional format of a strand when continuously casting strands by using a mould, involves at least one mould side wall which is displaced relative to an opposite mould side wall and has its inclination changed. According to the method the displacement of the mould side wall during casting is effected by step-wise changing of the inclination in a manner that, in a first step, the upper or lower rim region of the mould side wall is displaced in one direction, and, in a second step, the opposite rim region of this mould side wall is displaced in the same direction.

14 Claims, 4 Drawing Figures

METHOD OF CHANGING THE CROSS SECTIONAL FORMAT OF A STRAND AND A PLATE MOULD FOR CARRYING OUT THE METHOD

BACKGROUND OF THE INVENTION

The invention relates to apparatus and a method of changing the cross-sectional format of a strand when continuously casting strands with a mould, at least one side wall of the mould being adjusted relative to an opposite mould side wall, and its inclination being changed.

For changing the cross-sectional format of a strand, such as e.g. for changing the strand width of a slab, the continuous casting process hitherto has had to be interrupted. It was only after displacing the mould narrow sides to the new cross-sectional format of the strand, that the casting process could be started anew by using a starter bar, and this only after having carried out the necessary set-up. This resulted first in a loss of production due to the time expenditure necessary for setting up the plant, and secondly in a deterioration of the yield due to the resulting end and starting scrap, and due to the resulting residual steel in the distributor vessel.

From German Offenlegungsschrift No. 2,018,962, a specially designed mould is known with which the changing of the format of a strand is feasible without using a starter bar. For this purpose, the mould comprises mould side walls that are subdivided at half-height. For changing the format, at first the bath level in the mould is lowered to below the divisional plane of the mould side walls. Then the upper wall parts of the divided side walls are each laterally displaced in accordance with the new cross-sectional format of the strand, whereupon a specially manufactured cooling scrap container containing cooling scrap is inserted. The bath level is next raised, and finally the lower wall part of the divided mould narrow side wall is laterally displaced in accordance with the upper wall part. Changing of the format according to German Offenlegungsschrift No. 2,018,962 is cumbersome to carry out, requires an interruption of the casting process and a complex design of the mould. Furthermore, the production of cooling scrap containers is necessary, which—as regards their dimensions—have to precisely correspond to the new and to the old cross-sectional formats of the strand. Insertion of the cooling scrap containers requires additional manipulations.

SUMMARY OF THE INVENTION

The invention aims at avoiding these disadvantages and difficulties and has as its object to provide a method of changing the cross-sectional format of a strand which can be carried out using moulds of a conventional type while maintaining the casting process, i.e. without stoppage or interruption of the same.

This object is achieved according to the invention in that displacement of the mould side wall during casting is effected by step-wise changing of its inclination in such a manner that, in a first step, the upper or the lower rim part of the mould side wall is displaced in one direction, and afterwards, in a second step, the opposite rim part of this side wall is displaced in the same direction. If desired, these displacement steps are repeated once or several times.

Preferably, the inclination of the mould side wall is changed by maximally 3.0°, advantageously by 0.2 to 1.2°, whereby only a particularly gentle strain on the already solidified strand skin is ensured.

This method can be applied in a particularly advantageous manner for increasing the cross-sectional format of a strand. In particular, in a first step the lower rim part of the mould side wall is displaced outwardly until the mould side wall is in an approximately perpendicular position, and then in a second step the upper rim part of this mould side wall is also displaced outwardly until the necessary inclination of the mould side wall is reached.

It is also possible to apply the method in such a way that the mould side wall is brought into the position corresponding to the new cross-sectional format of the strand in only three steps. In a first step the lower rim part of the mould side wall is displaced outwardly until the mould side wall is in an approximately perpendicular position. Then in a second step the upper rim part of the mould side wall is displaced outwardly until the upper rim part has reached a position corresponding to the new cross-sectional format of the strand, the inclination of the mould side wall being up to 30° relative to the perpendicular. Finally, in a third step the lower rim part of this mould side wall is displaced outwardly until the necessary inclination of the mould side wall in accordance with the new cross-sectional format of the strand has been reached.

It is suitable to adjust the casting speed in the region of 0.1 to 0.5 m/min, preferably 0.2 to 0.4 m/min, during the changing of the cross-sectional format of the strand. By this measure, it is assured that the strand skin will lift off from the mould walls early, i.e. the skin will be in touching contact with the mould walls only over a short distance, whereby the displacement of the mould side wall can be realized in an easier way.

For preventing the clamping of the displaceable side wall between the mould side walls bordering thereon, a gap of about 0.1 mm advantageously is provided between the displaceable mould side wall whose inclination can be changed, and the two side walls bordering thereon, during the changing of the cross sectional format of the strand.

The method according to the invention may be applied with particular advantage to a mould having a rectangular cross section for continuously casting steel slabs in which each narrow-side wall of the mould has separate adjustment drives hinged to the upper rim part and to the lower rim part, respectively. These adjustment drives are mounted in a frame surrounding the mould side walls and are actuatable independently of each other. The mould is characterized in that at least one adjustment drive is articulately mounted at the frame, so as to allow for pivotal movement in the symmetrical plane that extends parallel to the broad-side walls.

According to another embodiment, the mould is characterized in that at least one adjustment drive is articulately connected with the narrow-side wall by means of a link guide.

BRIEF DESCRIPTION OF THE DRAWINGS

The invention will now be explained in more detail with reference to the accompanying drawings, wherein.

DESCRIPTION OF THE ILLUSTRATIVE EMBODIMENTS

Figure 1:
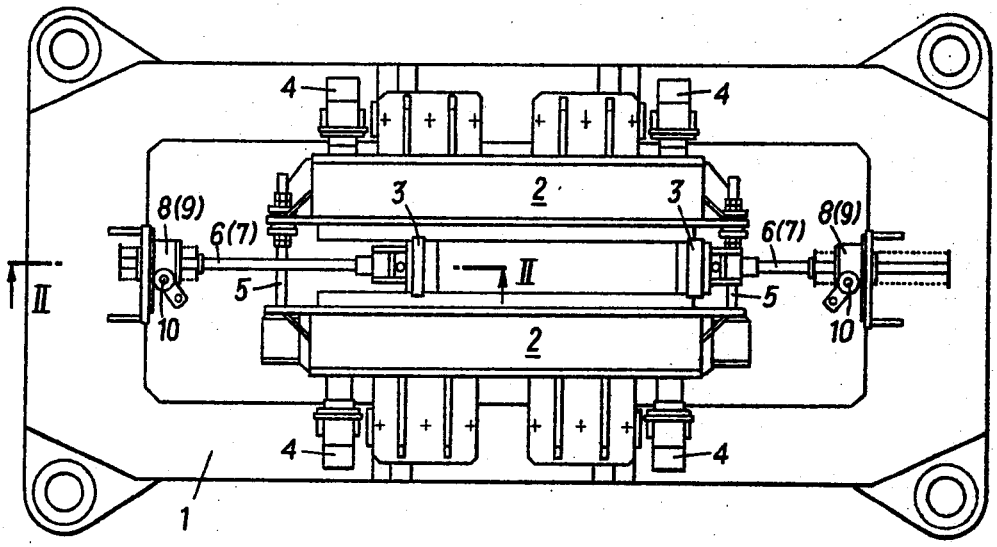
FIG. 1 is a top view of a mould.

A frame-shaped water chamber 1 is provided for a mould for slabs, in which broad-side walls 2 and narrow-side walls 3 are arranged. On the sides facing each other, the mould walls 2, 3 carry copper plates that come into contact with the melt (not illustrated). The broad-side walls 2 are displaceable in the direction away from and towards each other by adjustment drives 4 mounted at the water chamber 1, and can be fixed in various positions relative to each other by fixing spindles 5, so that it is possible to clamp the narrow-side walls 3 between the broad-side walls or to provide a gap of constant size between the broad-side walls and the narrow-side walls. The cooling water connections of the broad and narrow sides to the water chamber are not illustrated for reasons of clarity.

Figure 2:
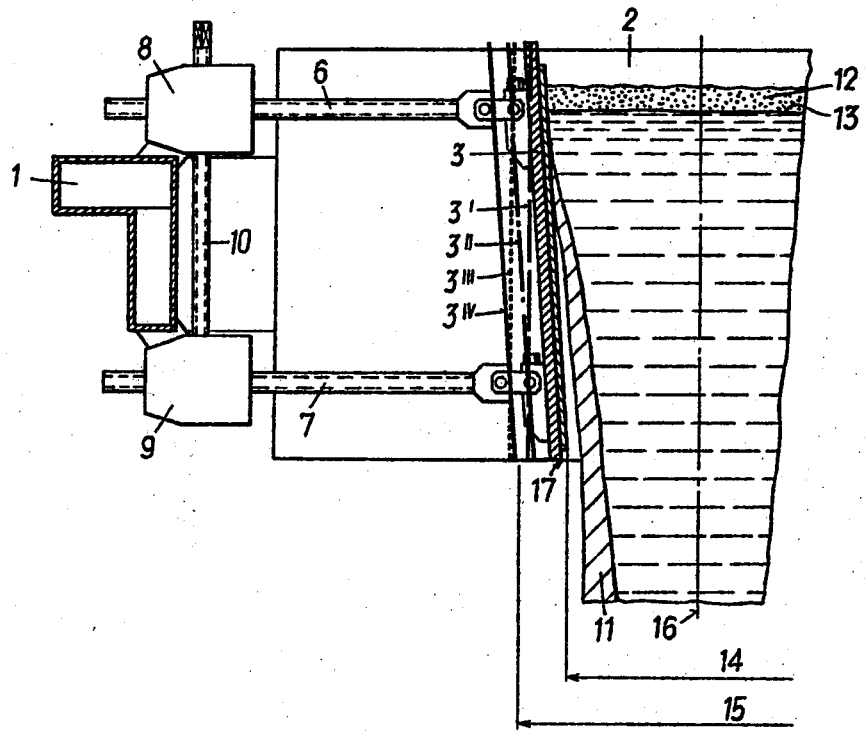
FIG. 2 illustrates a partial section along line II—II of FIG. 1, on an enlarged scale and in schematical representation.

For displacing each narrow-side wall 3 and adjusting its inclination, two adjustment drives are arranged one above the other FIG. 2 and are connected with the upper and lower rim parts of a narrow-side wall, respectively. These drives are designed as threaded spindles 6 and 7. The threaded spindles 6, 7 are each mounted in gear casings 8, 9 that are fastened to the water chamber 1. Instead of threaded spindles, toothed racks may also be provided. Each threaded spindle 6, 7 is articulately connected with the narrow-side wall, a change of the inclination of each narrow-side wall in a certain region thus being possible.

Figure 3:
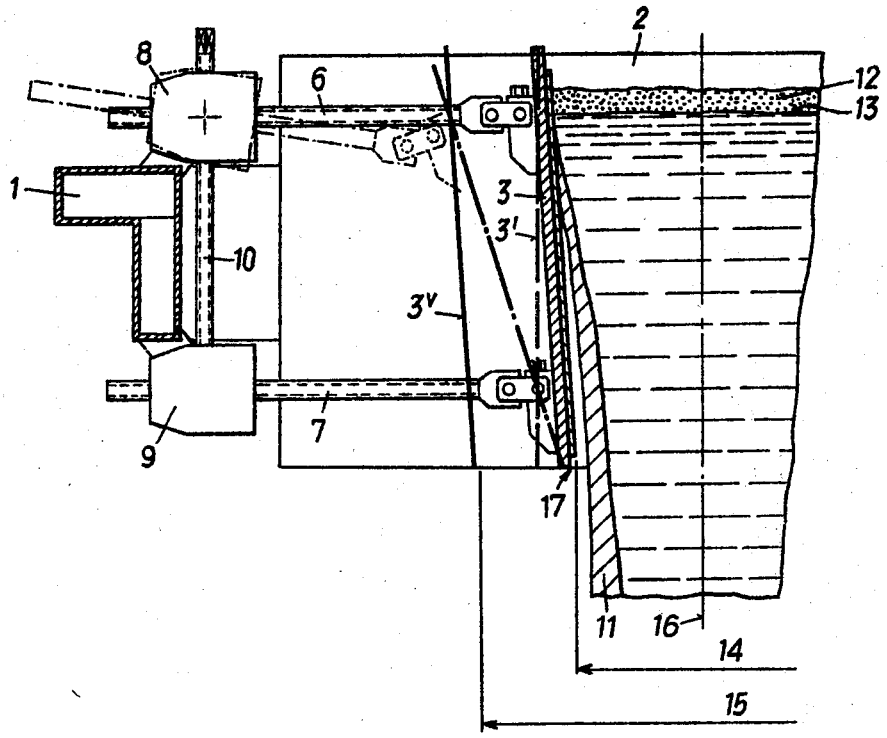
FIGS. 3 and 4, in an illustration analogous to FIG. 2, also show partial sections through the mould.

The threaded spindles 6, 7 of each narrow-side wall are displaceable by a common articulation drive-shaft 10. The articulation shaft can be actuated by a crank handle that can be put onto the same. By means of couplings, not illustrated in the drawing, the articulation shaft can be brought into an operative connection only with the upper threaded spindle 6, or only with the lower threaded spindle 7, so that it is possible to drive either of the two threaded spindles 6, 7 on its own. In FIGS. 2 and 3, the mould is illustrated during the casting process. The solidified strand skin is denoted by 11, and the metal level covered by a casting powder 12 is denoted by 13.

Instead of an articulation drive-shaft 10, it is also possible for each threaded spindle 6, 7 to be actuated by its own crank handle.

When carrying out the method according to the invention for changing the cross-sectional format of a strand, the operation proceeds in the following way:

Suppose that the narrow side 3, which is adjusted for a slab width that is denoted by 14 in FIG. 2, is to be adjusted to a new slab width denoted by 15. Considering that the perpendicular middle line of the slab width 14 is denoted by 16, the new position is achieved by first moving the narrow-side wall 3 illustrated in FIG. 2 in full lines. This wall has an inclination that takes into consideration the shrinkage of the strand according to this slab width, which inclination is illustrated in an exaggerated way for reasons of clarity. The movement of wall 3 in a first displacement step is achieved by actuating the lower threaded spindle 7 so as to position the wall into an approximately perpendicular position $3^{I}$, which is illustrated by FIG. 2 in a broken line. Thereafter, in a second step the narrow-side wall is inclined into a position $3^{II}$, which is illustrated by a dot-and-dash line, by actuating the upper threaded spindle 6. Whereupon, in a next step, the narrow-side wall is again moved into an approximately perpendicular position $3^{III}$ (illustrated by dots) by actuation of the lower threaded spindle 7. In a final step, the necessary adjustment of the inclination of the narrow-side wall according to the new slab format is effected by actuation of the upper threaded spindle 6. This newly adjusted position of the narrow-side wall is illustrated in FIG. 2 in full line and is denoted by $3^{IV}$. The steps described can be voluntarily repeated, depending on the new slab width desired. The various positions of the narrow-side wall are drawn in FIG. 2 in a strongly exaggerated way for reasons of clarity.

Suitably, a gap having a thickness of about 0.1 mm is provided between the broad-side wall and the narrow-side wall, which gap is sealed by a refractory cement at the onset of the casting process. By this means, the narrow-side wall can be easily adjusted. It is also possible to provide no gap between the broad-side and the narrow-side walls, but instead to press the broad-side walls only with very little force towards the narrow-side walls, the narrow-side walls thus remain easily displaceable.

The realization of the first step is facilitated by prior reduction of the casting speed, for instance to 0.4 m/min, since thereby the strand skin will lift off the narrow-side wall after only a short time of contact with the narrow-side wall, i.e. just below the casting level, as is illustrated in FIG. 2.

By further lowering the casting speed, the strand skin will lift off the wall even earlier, thus greater changes of inclination of the narrow-side wall are made possible.

At the lower half of the narrow-side wall, no supporting effect will take place any longer with the casting speed reduced (the normal casting speed being taken to be between 1.5 to 2.5 m/min), so that the moving away of the narrow-side wall from the strand skin in the lower region is feasible without damaging the strand skin. At the upper rim part of the side wall, the strand skin, which is extremely thin, continues to be supported during this method step.

During the second method step, in which the narrow-side wall is again inclined by actuating the upper threaded spindle 6, the lower threaded spindle 7 suitably is fixed. It may, however, also be actuated in order to keep the lower rim 17 of the narrow-side wall—which, when only actuating the upper threaded spindle 6, is pivoted inward (i.e. about the hinge point of the lower threaded spindle 7)—in the position which it reached in the first method step, and not to press it into the already solidified strand skin, damaging the same.

During the second method step, a gap tapering downwardly will form in the upper region of the mould between the narrow-side wall and the already solidified strand skin 11, into which gap, however, steel enters immediately, solidifying on contact with the narrow-side wall. Thereby, a seal is always ensured during the change of inclination of the narrow-side wall, thus preventing steel from escaping from the mould.

When carrying out the displacement steps described, the newly forming strand skin in the region of the bath level 13 will always have time to grow to a sufficiently great thickness, since during the first displacement step and during all odd numbered displacement steps possibly following, during which only the lower rim part of the side wall is displaced outwardly, the upper rim part of the side wall will carry out only a negligible pivotal movement about the hinge point of the upper threaded spindle 6. The method described therefore, despite continuous movement of the narrow-side wall, offers sufficient "pauses" for the newly formed strand skin during which the strand skin can thicken without being affected by the change of format. Thus, the method described differs in an advantageous way from common methods employing a parallel displacement of the narrow-side wall, in which the strand skin newly formed in the region of the bath level is not given a "pause" during the parallel displacement of the narrow-side wall at constant speed, whereby the danger of a strand breakthrough is always present.

Each position of the narrow-side wall can be checked exactly during the displacement procedure by way of a count of the number of revolutions of the threaded spindle, whose thread pitch is known.

After having carried out the change of format, the casting speed is again increased to the desired value. The displacement procedure described can be carried out at one or at both narrow-side walls. In the first case, in which the narrow-side wall that is not moved serves as a reference line, the middle line 16 of the strand changes.

Figure 4:
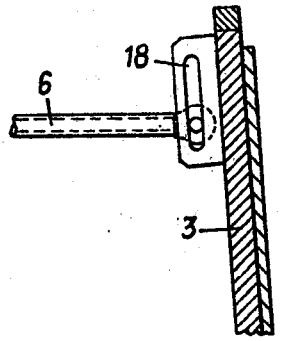

With reference to FIG. 3, the displacement of the narrow-side wall to the new slab width in only three steps is explained in the following manner: In a first step, the narrow-side wall is displaced into an approximately perpendicular position $3^{I}$ (illustrated in broken lines) by means of the lower threaded spindle 7. Thereafter, in a second step, the narrow-side wall is inclined by displacement of the upper threaded spindle into a position in which the upper end part of this narrow-side wall assumes a position which corresponds to the new slab width 15. During this change of inclination, which may amount to up to 30°, the lower rim part of the narrow-side wall suitably is also adjusted outwardly so the lower rim 17 of the narrow-side wall is not pressed into the strand skin by the pivotal movement of the narrow-side wall. As can be seen from FIG. 3, this great change of inclination causes a change in the height of the hinge point of the threaded spindle at this narrow-side wall, which can be balanced out by an articulated suspension of the gear 8 of the upper threaded spindle 6 at the water chamber 1. It is also possible to arrange the gear casing 9, that is attributed to the lower threaded spindle 7, articulately at the water chamber 1. Furthermore, it is possible to guide the threaded spindle in a link 18 extending parallel to the side wall (illustrated in FIG. 4), in order to balance out this change in height.

In the third method step, the lower rim part of the narrow-side wall is displaced outwardly by actuation of the lower threaded spindle 7, until the inclination of the narrow-side wall has obtained the inclination that is necessary in accordance with the new slab width. The end position of the narrow-side wall is illustrated in FIG. 3, again in full lines and denoted by $3^{V}$.

The invention is not limited to the changes of format explained in more detail with reference to the drawings, the displacement steps can be applied in a modified way, as desired.

Thus, it is also possible to adjust the position of the narrow sides from one slab width to a smaller width without interrupting casting, wherein suitably, in a first displacement step, the upper rim part of the narrow-side wall is adjusted inwardly up to an approximately perpendicular position, and in a second displacement step, the lower rim part of the narrow side is also displaced inwardly up to the necessary inclination. These displacement steps are repeated according to the new position to which the the narrow sides are to be adjusted.

The method according to the invention can be applied also for changes of format at casting plants for billets or blooms.

What I claim is:

1. In a method of increasing and decreasing, respectively, the cross-sectional format of a continuously cast strand formed by a mould having oppositely arranged mould side walls, which method includes displacing at least one of these mould side walls relative to the oppositely arranged mould side wall and changing the inclination of said mould side wall, said mould side wall including an upper rim region and a lower rim region, the improvement which is characterized in that displacement of said at least one mould side wall is effected during casting, at a particular casting speed such that the strand is out of contact with the mould side wall closely below the casting level, by step-wise changing of its inclination in a manner so as to displace, in a first step, said lower rim region or said upper rim region, depending on whether the cross section is being increased or decreased, respectively, in a certain direction, i.e. outwardly or inwardly, respectively; and to displace, in a second step, the respective other rim region of said at least one mould side wall into the same direction.

2. A method as set forth in claim 1, wherein said first step and said second step are repeated once.

3. A method as set forth in claim 1, wherein said first step and said second step are repeated several times.

4. A method as set forth in claim 1, wherein the inclination of said at least one mould side wall is changed by maximally 3.0°.

5. A method as set forth in claim 1, wherein the inclination of said at least one mould side wall is changed by 0.2° to 1.2°.

6. A method of increasing the cross sectional format of a strand as set forth in claim 1, wherein, in a first step, said lower rim region of said at least one mould side wall is displaced outwards until said at least one mould side wall assumes an approximately perpendicular position, and wherein, in a second step, said upper rim region of said at least one mould side wall is also displaced outwards until said at least one mould side wall has assumed the necessary inclination.

7. A method as set forth in claim 6, wherein said at least one mould side wall is brought into a position corresponding to the new cross sectional format of said strand in only three steps, the first step comprising displacing said lower rim region of said at least one mould side wall outwards until said at least one mould side wall assumes an approximately perpendicular position, the second step comprising displacing said upper rim region of said at least one mould side wall outwards until said upper rim region has assumed a position corresponding to the new cross-sectional format, the inclination of said at least one mould side wall being up to 30° relative to the perpendicular, and the third step comprising displacing said lower region of said at least one mould side wall outwards until the necessary inclination of said at least one mould side wall, in accordance with the new cross-sectional format of the strand, has been reached.

8. A method as set forth in claim 1, 6 or 7, wherein the casting speed is between 0.1 to 0.5 m/min during changing of the cross-sectional format of the strand.

9. A method as set forth in claim 1, 6 or 7, wherein the casting speed is between 0.2 to 0.4 m/min during changing of the cross-sectional format of the strand.

10. A method as set forth in claim 1, wherein, during changing of the cross-sectional format of the strand, a gap is provided between said at least one mould side wall that is to be displaced and changed in its inclination, and the two mould side walls bordering upon said at least one mould side wall, which gap has a size of approximately 0.1 mm.

11. In a method of increasing the cross-sectional format of a strand when continuously casting strands by using a mould having oppositely arranged mould side walls, which method includes displacing at least one of these mould side walls relative to the oppositely arranged mould side wall and changing the inclination of said mould side wall, said mould side wall including an upper rim region and a lower rim region, the improvement which is characterized in that displacement of said at least one mould side wall is effected during casting, at a particular casting speed such that the strand is out of contact with the mould side wall closely below the casting level, by step-wise changing its inclination, wherein, in a first step, said lower rim region of said at least one mould side wall is outwardly displaced from an inclined position until said at least one mould side wall assumes an approximately perpendicular position, and wherein, in a second step, said upper rim region of said at least one mould side wall is also outwardly displaced so that said at least one mould side wall again assumes an inclined position.

12. A method as set forth in claim 11, wherein said first step and said second step are repeated once.

13. A method as set forth in claim 11, wherein said first step and said second step are repeated several times.

14. A method as set forth in claims 11, 12, or 13 wherein, in said second step, said upper rim region of said at least one mould side wall is outwardly displaced until said at least one mould side wall has assumed the necessary inclination.

* * * * *